US006280302B1

(12) United States Patent
Hashish et al.

(10) Patent No.: US 6,280,302 B1
(45) Date of Patent: Aug. 28, 2001

(54) METHOD AND APPARATUS FOR FLUID JET FORMATION

(75) Inventors: Mohamed A. Hashish, Bellevue; Steven J. Craigen, Auburn; Felice M. Sciulli, Issaquah, all of WA (US); Yasuo Baba, Nagoya (JP)

(73) Assignee: Flow International Corporation, Kent, WA (US)

( * ) Notice: Subject to any disclaimer, the term of this patent is extended or adjusted under 35 U.S.C. 154(b) by 0 days.

(21) Appl. No.: 09/275,520

(22) Filed: Mar. 24, 1999

(51) Int. Cl.[7] ..... B24C 5/04
(52) U.S. Cl. ..... 451/102; 451/72; 451/446
(58) Field of Search ..... 451/60, 75, 99–102, 451/446

(56) References Cited

U.S. PATENT DOCUMENTS

| | | | | |
|---|---|---|---|---|
| 4,555,872 | | 12/1985 | Yie | 51/439 |
| 5,018,317 | * | 5/1991 | Kiyoshige et al. | 451/102 |
| 5,144,766 | * | 9/1992 | Hashish et al. | 451/102 |
| 5,155,946 | * | 10/1992 | Domann | 451/102 X |
| 5,335,459 | * | 8/1994 | Dale | 451/102 |
| 5,551,909 | * | 9/1996 | Bailey | 451/102 X |
| 5,626,508 | * | 5/1997 | Rankin et al. | 451/102 |
| 5,643,058 | | 7/1997 | Erichsen et al. | 451/99 |
| 5,851,139 | | 12/1998 | Xu | 451/102 |

FOREIGN PATENT DOCUMENTS

0382319A2 8/1990 (EP) .
0391500A2 10/1990 (EP) .

OTHER PUBLICATIONS

Sato, Kazunori et al., "A Study On Peening By Submerged Ultra–High–Speed Water–Jets," pp. 413–424.

Nishida, Nobuo et al., "The Development And Application Of Cleaning System By Submerged Jet," pp. 365–372.

* cited by examiner

*Primary Examiner*—Joseph J. Hail, III
*Assistant Examiner*—Anthony Ojini
(74) *Attorney, Agent, or Firm*—Seed Intellectual Property Law Group PLLC

(57) ABSTRACT

A method and apparatus for controlling the coherence of a high-pressure fluid jet directed toward a selected surface. In one embodiment, the coherence is controlled by manipulating a turbulence level of the fluid forming the fluid jet. The turbulence level can be manipulated upstream or downstream of a nozzle orifice through which the fluid passes. For example, in one embodiment, the fluid is a first fluid and a secondary fluid is entrained with the first fluid. The resulting fluid jet, which includes both the primary and secondary fluids, can be directed toward the selected surface so as to cut, mill, roughen, peen, or otherwise treat the selected surface. The characteristics of the secondary fluid can be selected to either increase or decrease the coherence of the fluid jet. In other embodiments, turbulence generators, such as inverted conical channels, upstream orifices, protrusions and other devices can be positioned upstream of the nozzle orifice to control the coherence of the resulting fluid jet.

37 Claims, 10 Drawing Sheets

METHOD AND APPARATUS FOR FLUID JET FORMATION

TECHNICAL FIELD

This invention relates to methods and devices for generating high-pressure fluid jets, and more particularly, to methods and devices for generating fluid jets having a controlled level of coherence.

BACKGROUND OF THE INVENTION

Conventional fluid jets have been used to clean, cut, or otherwise treat substrates by pressurizing and focusing jets of water or other fluids up to and beyond 100,000 psi and directing the jets against the substrates. The fluid jets can have a variety of cross-sectional shapes and sizes, depending upon the particular application. For example, the jets can have a relatively small, round cross-sectional shape for cutting the substrates, and can have a larger, and/or non-round cross-sectional shape for cleaning or otherwise treating the surfaces of the substrates.

One drawback with conventional fluid jets is that they may tear or deform certain materials, such as fiberglass, cloth, and brittle plastics. A further drawback is that the effectiveness of conventional fluid jets may be particularly sensitive to the distance between the substrate and the nozzle through which the fluid jet exits. Accordingly, it may be difficult to uniformly treat substrates having a variable surface topography. It may also be difficult to use the same fluid jet apparatus to treat a variety of different substrates. Still a further disadvantage is that some conventional fluid jet nozzles, particularly for non-round fluid jets, may be difficult and/or expensive to manufacture.

Accordingly, there is a need in the art for an improved fluid jet apparatus that is relatively simple to manufacture and is capable of cutting or otherwise treating a variety of substrates without being overly sensitive to the stand-off distance between the nozzle and the substrate. The present invention fulfills these needs, and provides further related advantages.

SUMMARY OF THE INVENTION

Briefly, the present invention provides a method and apparatus for controlling the coherence of a high-pressure fluid jet. In one embodiment of the invention, the fluid jet can include two fluids: a primary fluid and a secondary fluid. The primary fluid can pass through a nozzles orifice and into a downstream conduit. At least one of the nozzle and the conduit can have an aperture configured to be coupled to a source of the secondary fluid such that the secondary fluid is entrained with the primary fluid and the two fluids exit the conduit through an exit opening.

In one aspect of this embodiment, the pressure of the primary and/or the secondary fluid can be controlled to produce a desired effect. For example, the secondary fluid can have a generally low pressure relative to the primary fluid pressure to increase the coherence of the fluid jet, or the secondary fluid can have a higher pressure to decrease the coherence of the fluid jet. In another aspect of this embodiment, the flow of the secondary fluid can be reversed, such that it is drawn in through the exit opening of the conduit and out through the aperture.

In a method in accordance with one embodiment of the invention, the fluid jet exiting the conduit can be directed toward a fibrous material to cut the material. In another embodiment of the invention, the conduit can be rotatable and the method can include rotating the conduit to direct the fluid jet toward the wall of a cylindrical opening, such as the bore of an automotive engine block.

In still further embodiments, other devices can be used to manipulate the turbulence of the fluid passing through the nozzle and therefore the coherence of the resulting fluid jet. For example, turbulence generators such as an additional nozzle orifice, a protrusion, or a conical flow passage can be positioned upstream of the orifice to increase the turbulence of the flow entering the nozzle orifice.

DETAILED DESCRIPTION OF THE INVENTION

In general, conventional high pressure fluid jet methods and devices have been directed toward forcing a high pressure fluid through a nozzle orifice to produce highly focused or coherent liquid jets that can cut through or treat selected materials. By contrast, one aspect of the present invention includes controlling the coherence of the fluid jet by manipulating the turbulence level of the fluid upstream and/or downstream of the nozzle orifice. The turbulence level can be manipulated with a turbulence generator or turbulence generating means that can include, for example, a second orifice upstream of the nozzle orifice or a protrusion that extends into the flow upstream of the nozzle orifice. Alternatively, the turbulence generating means can include one or more apertures downstream of the nozzle orifice through which a second fluid is either pumped or evacuated. The pressure of the second fluid can be selected to either increase or decrease the coherence of the resulting fluid jet. Accordingly, the following description is directed to a variety of coherence controlling devices and methods, including turbulence generating means that can reduce the coherence of the fluid jet, as well as means for increasing the coherence of the fluid jet.

Figure 1B:
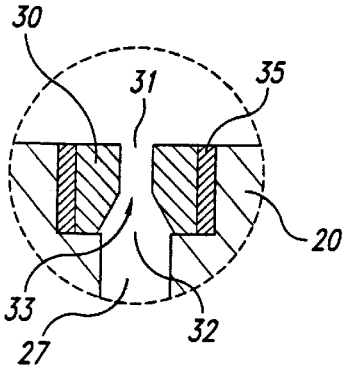
FIG. 1B is an enlarged cross-sectional side elevational view of a portion of the apparatus shown in FIG. 1A.
Figure 1A:
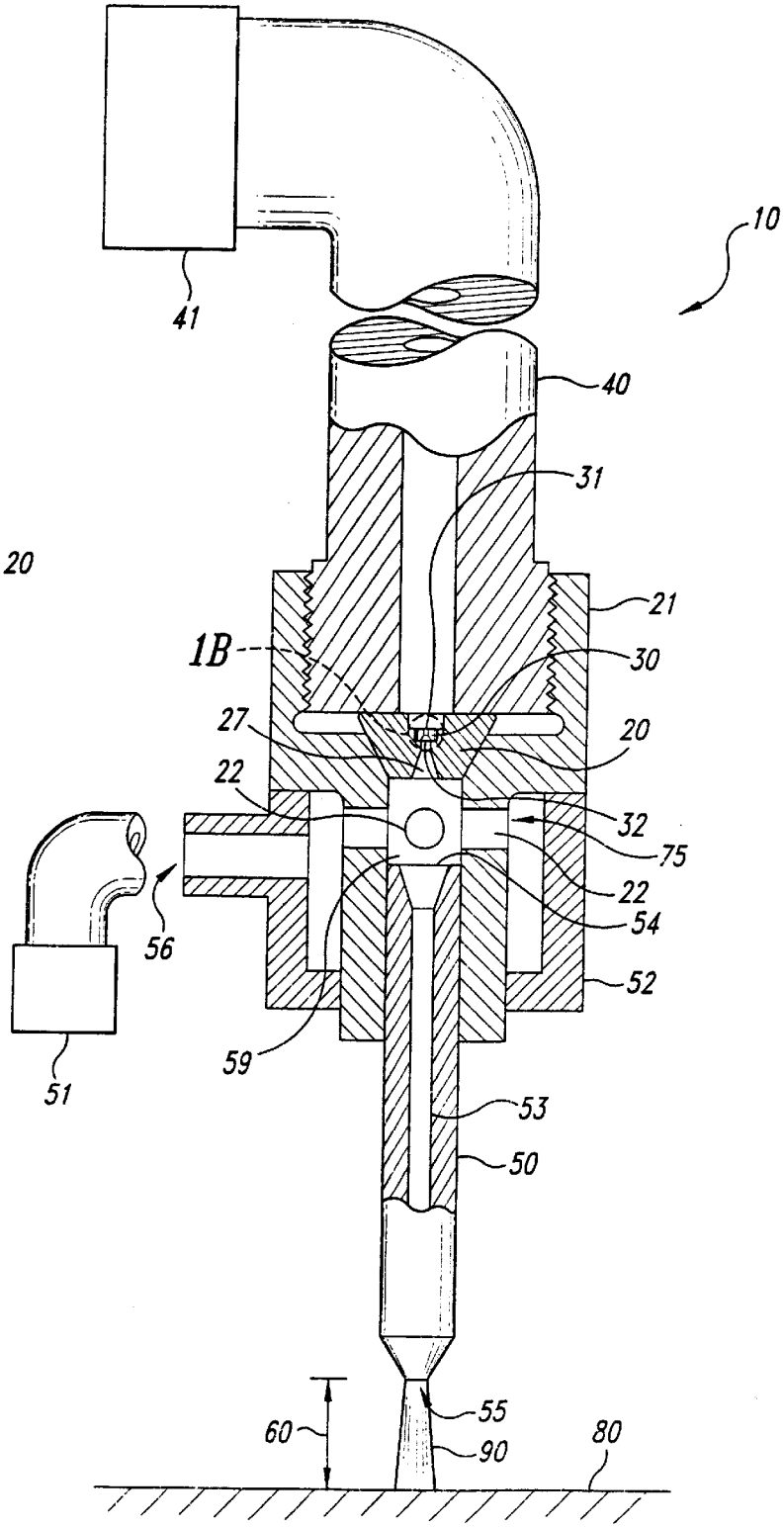
FIG. 1A is a partially schematic, partial cross-sectional side elevation view of an apparatus in accordance with an embodiment of the invention.

A fluid jet apparatus 10 in accordance with an embodiment of the invention is shown in FIGS. 1A and 1B. The apparatus 10 includes a supply conduit 40 that delivers a primary fluid to a nozzle 30. The apparatus 10 can further include a turbulence generator 75 which, in one aspect of this embodiment, includes secondary flow apertures 22 that entrain a secondary fluid with the primary fluid. The primary and secondary fluids can together pass into an axially elongated delivery conduit 50 and exit the delivery conduit 50 in the form of a fluid jet 90 that impacts a substrate 80 below.

More particularly, the apparatus 10 can include a primary fluid supply 41 (shown schematically in FIG. 1A) coupled to the supply conduit 40. The primary fluid supply 41 can supply a gas-phase fluid, such as air, or a liquid-phase fluid, such as water, saline, or other suitable fluids. The primary fluid supply 41 can also include pressurizing means, such as a pump with an intensifier or another high-pressure device, for pressurizing the primary fluid up to and in excess of 100,000 psi. For example, direct drive pumps capable of generating pressures up to 50,000 psi and pumps with intensifiers capable of generating pressures up to and in excess of 100,000 psi are available from Flow International Corporation of Kent, Wash., or Ingersoll-Rand of Baxter Springs, Kans. The particular pressure and pump chosen can depend on the characteristics of the substrate 80 and on the intended effect of the fluid jet 90 on the substrate 80, as will be discussed in greater detail below.

The supply conduit 40 is positioned upstream of the nozzle 30. In one embodiment, the nozzle 30 can be supported relative to the supply conduit 40 by a nozzle support 20. A retainer 21 can threadably engage the supply conduit 40 and bias the nozzle support 20 (with the nozzle 30 installed) into engagement with the supply conduit 40. The nozzle support 20 can include a passageway 27 that accommodates the nozzle 30 and directs the primary fluid through the nozzle 30. An annular nozzle seal 35 (FIG. 1B) can seal the interface between the nozzle 30 and the nozzle support 20.

The nozzle 30 can have a nozzle orifice 33 (FIG. 1B) that extends through the nozzle from an entrance opening 31 to an exit opening 32. In one embodiment, the nozzle orifice 33 can have a generally axisymmetric cross-sectional shape extending from the entrance opening 31 to the exit opening 32, and in other embodiments, one or more portions of the nozzle orifice 33 can have generally elliptical or other cross-sectional shapes for generating fluid jets having corresponding non-axisymmetric cross-sectional shapes. The nozzle 30 can be manufactured from sapphire, diamond, or another hard material that can withstand the high pressures and stresses created by the high-pressure primary fluid.

In one embodiment, an entrainment region 59 (FIG. 1A) is located downstream of the nozzle 30. In a preferred aspect of this embodiment, the entrainment region 59 has a flow area that is larger than that of the nozzle orifice 33 to allow for entraining the secondary fluid through the secondary flow apertures 22. In the embodiment shown in FIG. 1A, four circular secondary flow apertures 22 (three of which are visible in FIG. 1A) are spaced apart at approximately the same axial location relative to the nozzle 30. In alternate embodiments, more or fewer secondary flow apertures 22 having the same or other cross-sectional shapes can be positioned anywhere along a flow passage extending downstream of the exit orifice 32. The secondary flow apertures 22 can be oriented generally perpendicular to the direction of flow through the entrainment region 59 (as shown in FIG. 1A), or at an acute or obtuse angle relative to the flow direction, as is discussed in greater detail below with reference to FIG. 3.

In one embodiment, the region radially outward of the secondary flow apertures 22 can be enclosed with a manifold 52 to more uniformly distribute the secondary fluid to the secondary flow apertures 22. The manifold 52 can include a manifold entrance 56 that is coupled to a secondary fluid supply 51 (shown schematically in FIG. 1A). In one embodiment, the secondary fluid supply 51 can supply to the manifold 52 a gas, such as air, oxygen, nitrogen, carbon dioxide, or another suitable gas. In other embodiments, the secondary fluid supply 51 can supply a liquid to the manifold 52. In any of these embodiments, the secondary fluid supply 51 can also provide a vacuum source to have a desired effect on the coherence of the fluid jet 90, as is discussed in greater detail below.

The delivery conduit 50, positioned downstream of the entrainment region 59, can receive the primary and secondary fluids to form the fluid jet 90. Accordingly, the delivery conduit 50 can have an upstream opening 54 positioned downstream of the secondary flow apertures 22. The delivery conduit 50 can further include a downstream opening 55 through which the fluid jet 90 exits, and a channel 53 extending between the upstream opening 54 and the downstream opening 55. The delivery conduit 50 can be connected to the retainer 21 by any of several conventional means, including adhesives, and can include materials (such as stainless steel) that are resistant to the wearing forces of the fluid jet 90 as the fluid jet 90 passes through the delivery conduit 50.

In one embodiment, the flow area through the flow channel 53 of the delivery conduit 50 is larger than the smallest diameter of the nozzle orifice 33 through the nozzle 30, to allow enough flow area for the primary fluid to entrain the secondary fluid. For example, the nozzle orifice 33 can have a minimum diameter of between 0.003 inches and 0.050 inches and the delivery conduit 50 can have a minimum diameter of between 0.01 inches and 0.10 inches. The delivery conduit 50 can have an overall length (between the upstream opening 54 and the downstream opening 55) of between 10 and 200 times the mean diameter of the downstream opening of the delivery conduit 50, to permit sufficient mixing of the secondary fluid with the primary fluid. As used herein, the mean diameter of the downstream opening 55 refers to the lineal dimension which, when squared, multiplied by pi (approximately 3.1415) and divided by four, equals the flow area of the downstream opening 55.

The geometry of the apparatus 10 and the characteristics of the primary and secondary fluids can also be selected to produce a desired effect on the substrate. For example, when the apparatus 10 is used to cut fibrous materials, the primary fluid can be water at a pressure of between about 25,000 psi and about 100,000 psi (preferably about 55,000 psi) and the secondary fluid can be air at a pressure of between ambient pressure (preferred) and about 10 psi. When the minimum diameter of the nozzle orifice 33 is between about 0.005 inches and about 0.020 inches (preferably about 0.007 inches), the minimum diameter of the delivery conduit 50 can be between approximately 0.01 inches and 0.10 inches (preferably about 0.020 inches), and the length of the delivery conduit 50 can be between about 1.0 and about 5.0 inches (preferably about 2.0 inches).

Alternatively, when the apparatus 10 is used to peen an aluminum substrate, the primary fluid can be water at a pressure of between about 10,000 psi and about 100,000 psi (preferably about 45,000 psi) and the secondary fluid can be water at a pressure of between ambient pressure and about 100 psi (preferably about 60 psi), delivered at a rate of between about 0.05 gallons per minute (gpm) and about 0.5 gpm (preferably about 0.1 gpm). The minimum diameter of the nozzle orifice 33 can be between about 0.005 inches and about 0.020 inches (preferably about 0.010 inches), and the delivery conduit 50 can have a diameter of between about 0.015 inches and about 0.2 inches (preferably about 0.03 inches) and a length of between about 0.375 inches and about 30 inches (preferably about 4 inches). A stand-off distance 60 between the substrate 80 and the downstream opening 55 of the conduit 50 can be between about 1.0 inch and about 10.0 inches (preferably about 3.0 inches).

The mass flow and pressure of the secondary fluid relative to the primary fluid can be controlled to affect the coherence of the fluid jet 90. For example, where the primary fluid is water at a pressure of between 10,000 and 100,000 psi and the secondary fluid is air at ambient pressure or a pressure of between approximately 3 psi and approximately 20 psi, the secondary fluid flow rate can be between approximately 1% and approximately 20% of the primary fluid flow rate. At these flow rates, the secondary fluid can decrease the coherence of the fluid jet 90, causing it to change from a highly focused fluid jet to a more dispersed (or less coherent) fluid jet that includes discrete fluid droplets.

In any of the foregoing and subsequent methods, the apparatus 10 can be moved relative to the substrate 80 (or vice versa) to advance the fluid jet 90 along a selected path over the surface of the substrate 80. The speed, size, shape and spacing of the droplets that form the fluid jet 90 can be controlled to produce a desired effect (i.e., cutting, milling, peening, or roughening) on the substrate 80.

An advantage of the dispersed fluid jet 90 is that it can more effectively cut through certain fibrous materials, such as cloth, felt, and fiberglass, as well as certain brittle materials, such as some plastics. For example, the dispersed fluid jet can cut through fibrous materials without leaving ragged edges that may be typical for cuts made by conventional jets.

Another advantage is that the characteristics of the dispersed fluid jet 90 can be maintained for a greater distance downstream of the downstream opening 55 of the delivery conduit 50, even through the fluid jet itself may be diverging. For example, once the fluid jet 90 has entrained the secondary fluid in the controlled environment within the conduit 50, it may be less likely to entrain any additional ambient air after exiting the conduit 50 and may therefore be more stable. Accordingly, the fluid jet 90 can be effective over a greater range of stand-off distances 60. This effect is particularly advantageous when the same apparatus 10 is used to treat several substrates 80 located at different stand-off distances 60 from the downstream opening 55.

Still a further advantage of the apparatus 10 is that existing nozzles 30 that conventionally produce coherent jets can be installed in the apparatus to produce dispersed fluid jets 90 without altering the geometry of the existing nozzles 30. Accordingly, users can generate coherent and dispersed jets with the same nozzles.

The apparatus 10 shown in FIG. 1 can be used according to a variety of methods to achieve a corresponding variety of results. For example, as discussed above, the secondary fluid can be introduced into the fluid jet 90 to disperse the fluid jet 90 and increase the effectiveness with which the jet cuts through fibrous materials. In another embodiment, the secondary fluid can be introduced at low pressures (in the range of between approximately 2 psi and approximately 3 psi in one embodiment) to increase the coherence of the fluid jet 90. In one aspect of this embodiment, the secondary fluid generally has a lower viscosity than that of the primary fluid and can form an annular buffer between the primary fluid and the walls of the conduit 50. The buffer can reduce friction between the primary fluid and the conduit walls and can accordingly reduce the tendency for the primary fluid to disperse.

In still another embodiment, the secondary fluid can be a cryogenic fluid, such as liquid nitrogen, or can be cooled to temperatures below the freezing point of the primary fluid, so that when the primary and secondary fluids mix, portions of the primary fluid can freeze and form frozen particles. The frozen particles can be used to peen, roughen, or otherwise treat the surface of the substrate 80.

In yet another embodiment, the flow of the secondary fluid and/or the primary fluid can be pulsed to form a jet that has intermittent high energy bursts. The fluid can be pulsed by regulating either the mass flow rate or the pressure of the fluid. In a further aspect of this embodiment, the rate at which the fluid is pulsed can be selected (based on the length of the delivery conduit 50) to produce harmonics, causing the fluid jet 90 to resonate, and thereby increasing the energy of each pulse.

In still a further embodiment, the secondary fluid supply 51 can be operated in reverse (ie., as a vacuum source rather than a pump) to draw a vacuum upwardly through the downstream opening 55 of the delivery conduit 50 and through the apertures 22. The effect of drawing a vacuum from the downstream opening 55 through the delivery conduit 50 has been observed to be similar to that of entraining flow through the secondary flow apertures 22 and can either reduce or increase the coherence of the fluid jet 90. For example, in one embodiment, vacuum pressures of between approximately 20–26 in. Hg (below atmospheric pressure) have been observed to increase the coherence of the fluid jet 90. At these pressures, the vacuum can reduce the amount of air in the entrainment region 59 and can accordingly reduce friction between the primary fluid and air in the entrainment region 59. At other vacuum pressures between atmospheric pressure and 20 in. Hg below atmospheric pressure, the coherence of the fluid jet 90 can be reduced.

In yet another embodiment, the secondary fluid can be selected to have a predetermined effect on the substrate 80. For example, in one embodiment, the secondary fluid can be a liquid and the resulting fluid jet 90 can be used for peening or otherwise deforming the substrate 80. Alternatively, the secondary fluid can be a gas and the resulting fluid jet 90 can be used for peening or for cutting, surface texturing, or other operations that include removing material from the substrate 80.

Figure 2:
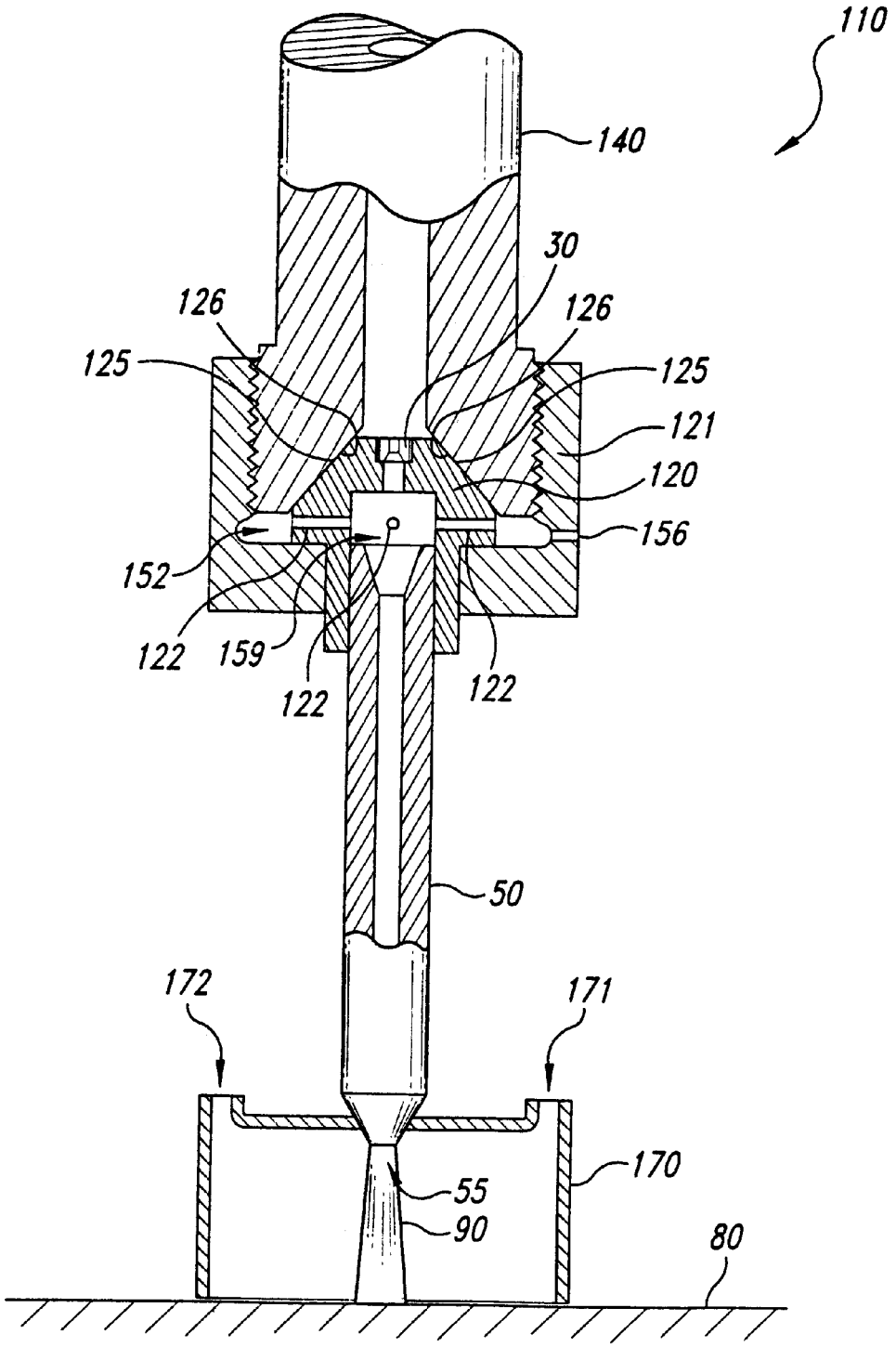
FIG. 2 is a partial cross-sectional side elevation view of an apparatus having a delivery conduit housing in accordance with another embodiment of the invention.

FIG. 2 is a cross-sectional side elevation view of a fluid jet apparatus 110 having a nozzle support 120 in accordance with another embodiment of the invention. As shown in FIG. 2, the nozzle support 120 has downwardly sloping upper surfaces 125 to engage corresponding downwardly sloping lower surfaces 126 of a supply conduit 140. The nozzle support 120 is held in place against the supply conduit 140 with a retainer 121. The retainer 121 forms a manifold 152 between an inner surface of the retainer and an outer surface of the nozzle support 120. Secondary flow apertures 122 direct the secondary fluid from the manifold 152 to an entrainment region 159 downstream of the nozzle 30. The manifold 152 can be coupled at a manifold entrance 156 to the secondary fluid supply 51 (FIG. 1A).

As is also shown in FIG. 2, the apparatus 110 can include a housing 170 around the downstream opening 55 of the delivery conduit 50. The housing 170 can extend between the delivery conduit 50 and the substrate 80 to prevent debris created by the impact of the fluid jet 90 on the substrate 80 from scattering. In one aspect of this embodiment, the walls of the housing 170 can be transparent to allow a user to view the fluid jet 90 and the substrate 80 immediately adjacent the fluid jet.

In another aspect of this embodiment, the housing 170 can include a first port 171 that can be coupled to a vacuum source (not shown) to evacuate debris created by the impact of the fluid jet 90 on the substrate 80. Alternatively (for example, when a vacuum is applied to the apertures 122), air or another gas can be supplied through the first port 171 for evacuation up through the delivery conduit 50, in a manner generally similar to that discussed above with reference to FIGS. 1A–B. In another alternate embodiment, a fluid can be supplied through the first port 171 and removed through a second port 172. For example, when it is desirable to maintain an inert environment at the point of contact between the fluid jet 90 and the substrate 80, an inert gas, such as nitrogen, can be pumped into the housing 170 through the first port 171 and removed through the second port 172.

Figure 3:
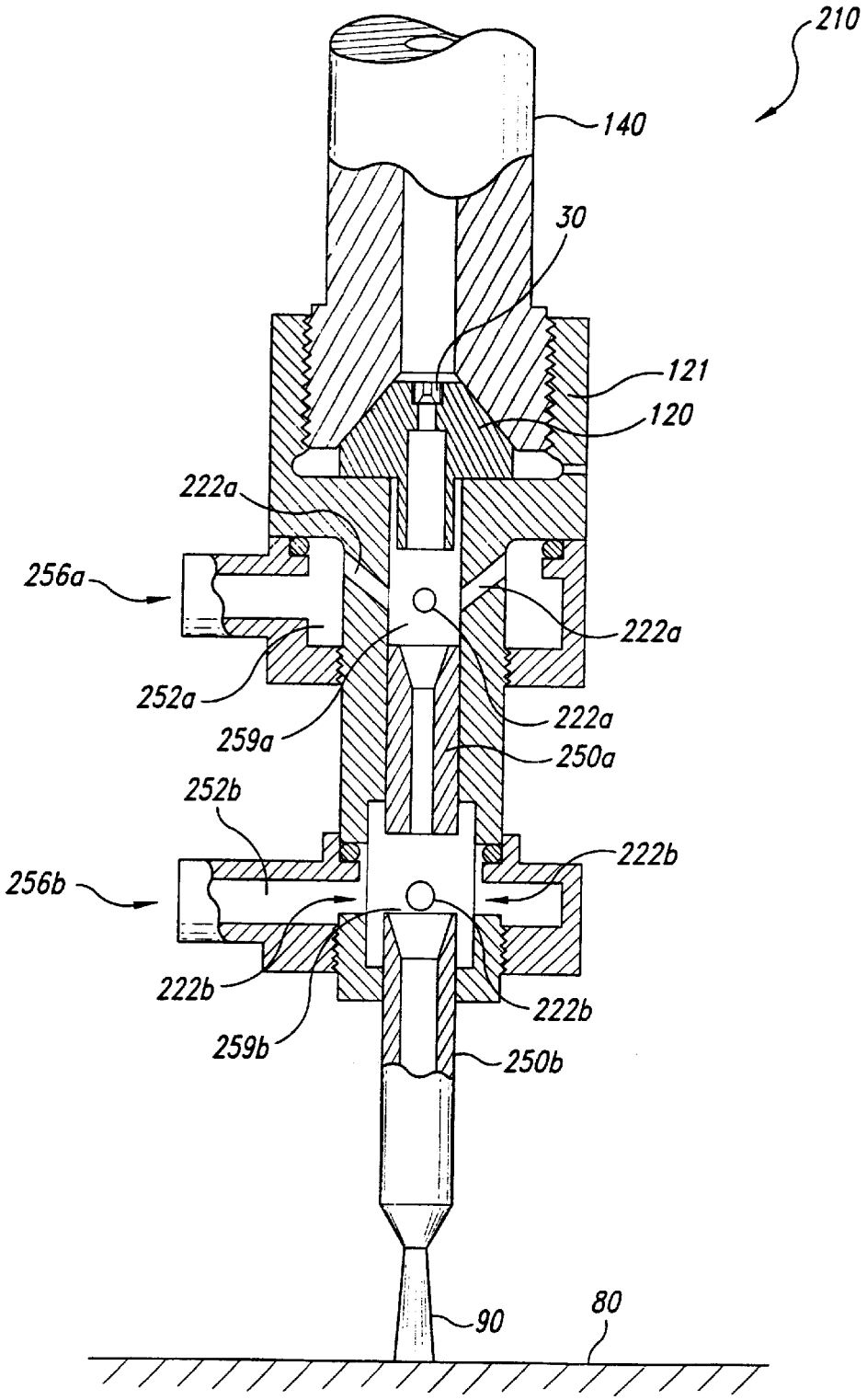
FIG. 3 is a partial cross-sectional side elevation view of an apparatus having a secondary flow introduced at two spaced apart axial locations in accordance with still another embodiment of the invention.

FIG. 3 is a partial cross-sectional side elevation view of an apparatus 210 having two manifolds 252 (shown as an upstream manifold 252*a* and a downstream manifold 252*b*) in accordance with another embodiment of the invention. As shown in FIG. 3, the upstream manifold 252*a* can include upstream flow apertures 222*a* that introduce a secondary fluid to an upstream entrainment region 259*a* and the downstream manifold 252*b* can include downstream flow apertures 222*b* that introduce a secondary fluid to a downstream entrainment region 259*b*. In one embodiment, the upstream and downstream apertures 222*a* and 222*b* can have the same diameter. In another embodiment, the upstream apertures 222*a* can have a different diameter than the downstream apertures 222*b* such that the amount of secondary flow entrained in the upstream entrainment region 259*a* can be different than the amount of flow entrained in the downstream entrainment region 259*b*. In still another embodiment, the upstream apertures 222*a* and/or the downstream apertures 222*b* can be oriented at an angle greater than or less than 90° relative to the flow direction of the primary fluid. For example, as shown in FIG. 3, the upstream apertures 222*a* can be oriented at an angle less than 90° relative to the flow direction of the primary fluid.

The upstream entrainment region 259*a* can be coupled to the downstream entrainment region 259*b* with an upstream delivery conduit 250*a*. A downstream delivery conduit 250*b* can extend from the downstream entrainment region 259*b* toward the substrate 80. The inner diameter of the downstream delivery conduit 250*b* can be larger than that of the upstream delivery conduit 250*a* to accommodate the additional flow entrained in the downstream entrainment region 259*b*. The upstream and downstream manifolds 252*a* and 252*b* can be coupled to the same or different sources of secondary flow 51 (FIG. 1A) via manifold entrances 256*a* and 256*b*, respectively, to supply the secondary flow to the entrainment regions 259.

In the embodiment shown in FIG. 3, the apparatus 210 includes two manifolds 252. In other embodiments, the apparatus 210 can include more than two manifolds and/or a single manifold that supplies secondary fluid to flow apertures that are spaced apart axially between the nozzle 30 and the substrate 80. Furthermore, while each manifold 252 includes four apertures 222 in the embodiment shown in FIG. 3 (three of which are visible in FIG. 3), the manifolds may have more or fewer apertures 222 in other embodiments.

An advantage of the apparatus 210 shown in FIG. 3 is that it may be easier to control the characteristics of the fluid jet 90 by supplying the secondary fluid at two (or more) axial locations downstream of the nozzle 30. Furthermore, the upstream and downstream manifolds 252*a* and 252*b* may be coupled to different secondary fluid supplies to produce a fluid jet 90 having a selected composition and a selected level of coherence. Alternatively, the same fluid may be supplied at different pressures and/or mass flow rates to each manifold 252. In either case, a further advantage of the apparatus 210 shown in FIG. 3 is that it may be easier to control the characteristics of the fluid jet 90 by supplying fluids with different characteristics to each manifold 252.

Figure 4A:
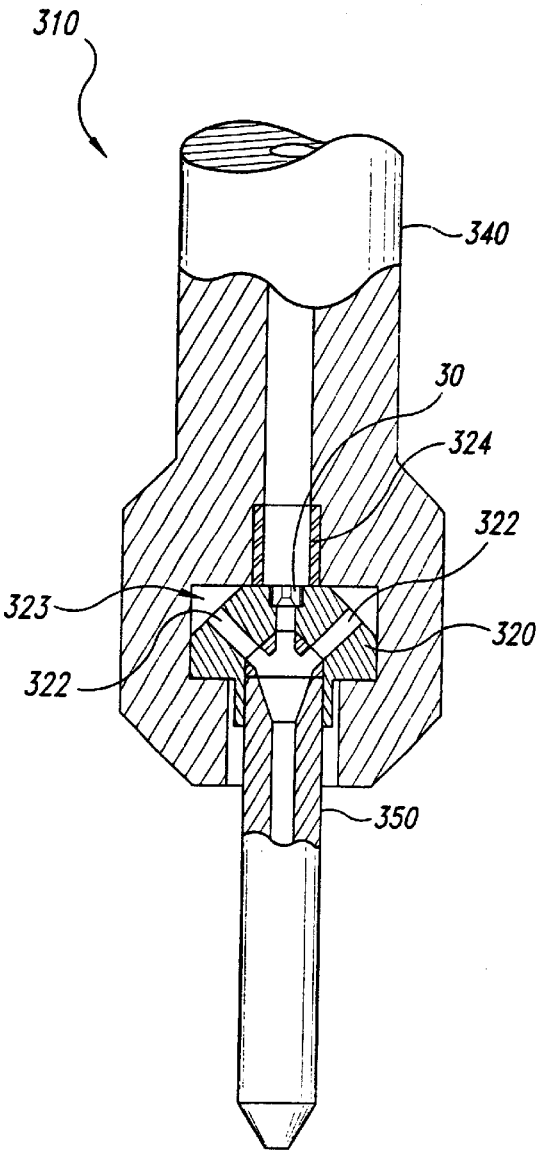
FIG. 4A is a partial cross-sectional front elevation view of an apparatus having a removable nozzle and conduit assembly in accordance with yet another embodiment of the invention.

FIG. 4A is a partial cross-sectional front elevation view of an apparatus 310 having a nozzle support 320 that is slideably removable from a supply conduit 340. Accordingly, the supply conduit 340 includes an access opening 323 into which the nozzle support 320 can be inserted. The supply conduit 340 also includes seals 324 that seal the interface between the access opening 323 and the nozzle support 320. In one embodiment, a delivery conduit 350 can be separately manufactured and attached to the nozzle support 320, and in another embodiment the nozzle support 320 and the delivery conduit 350 can be integrally formed. In either case, the nozzle support 320 can include secondary flow apertures 322 that supply the secondary fluid to the delivery conduit 350.

Figure 4B:
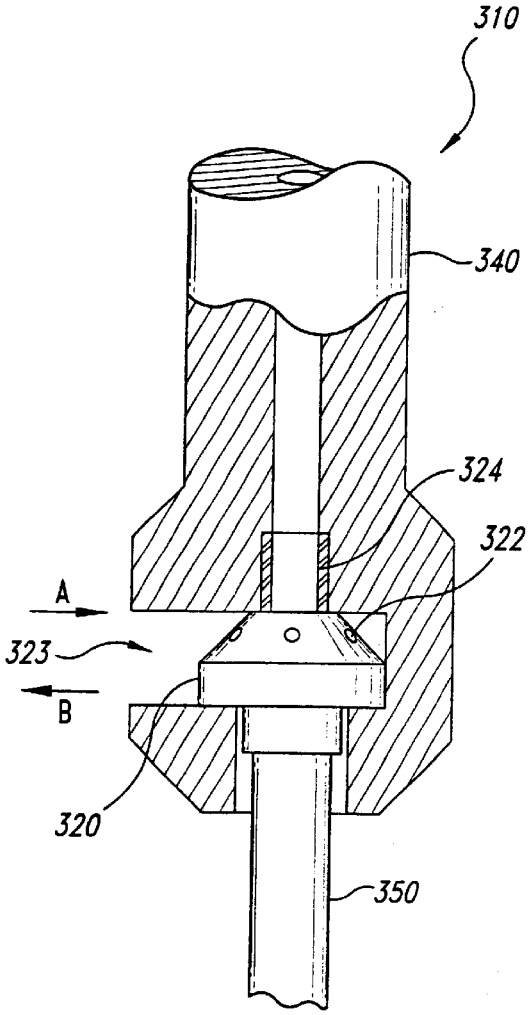
FIG. 4B is a partial cross-sectional side elevation view of the apparatus shown in FIG. 4A.

FIG. 4B is a partial cross-sectional side elevation view of the apparatus 310 shown in FIG. 4A. As shown in FIG. 4B, the nozzle support 320 can be moved into the aperture 323 in the direction indicated by arrow A to seat the nozzle support 320 and seal the nozzle support with the supply conduit 340. As is also shown in FIG. 4B, the access opening 323 is open to allow the secondary fluid to be drawn into the secondary flow apertures 322 from the ambient environment. In one embodiment, the ambient environment (and therefore the secondary fluid) can include a gas, such as air, and in another embodiment, the ambient environment and the secondary fluid can include a liquid, such as water. In either case, the nozzle support 320 and the delivery conduit 350 can be removed as a unit by translating them laterally away from the supply conduit 340, as indicated by arrow B. Accordingly, users can replace a nozzle support 320 and delivery conduit 350 combination having one set of selected characteristics with another combination having another set of selected characteristics. Selected characteristics can include, for example, the size of the nozzle 30 (FIG. 4A), the number and size of secondary flow apertures 322, and the size of delivery conduit 350.

Figure 5:
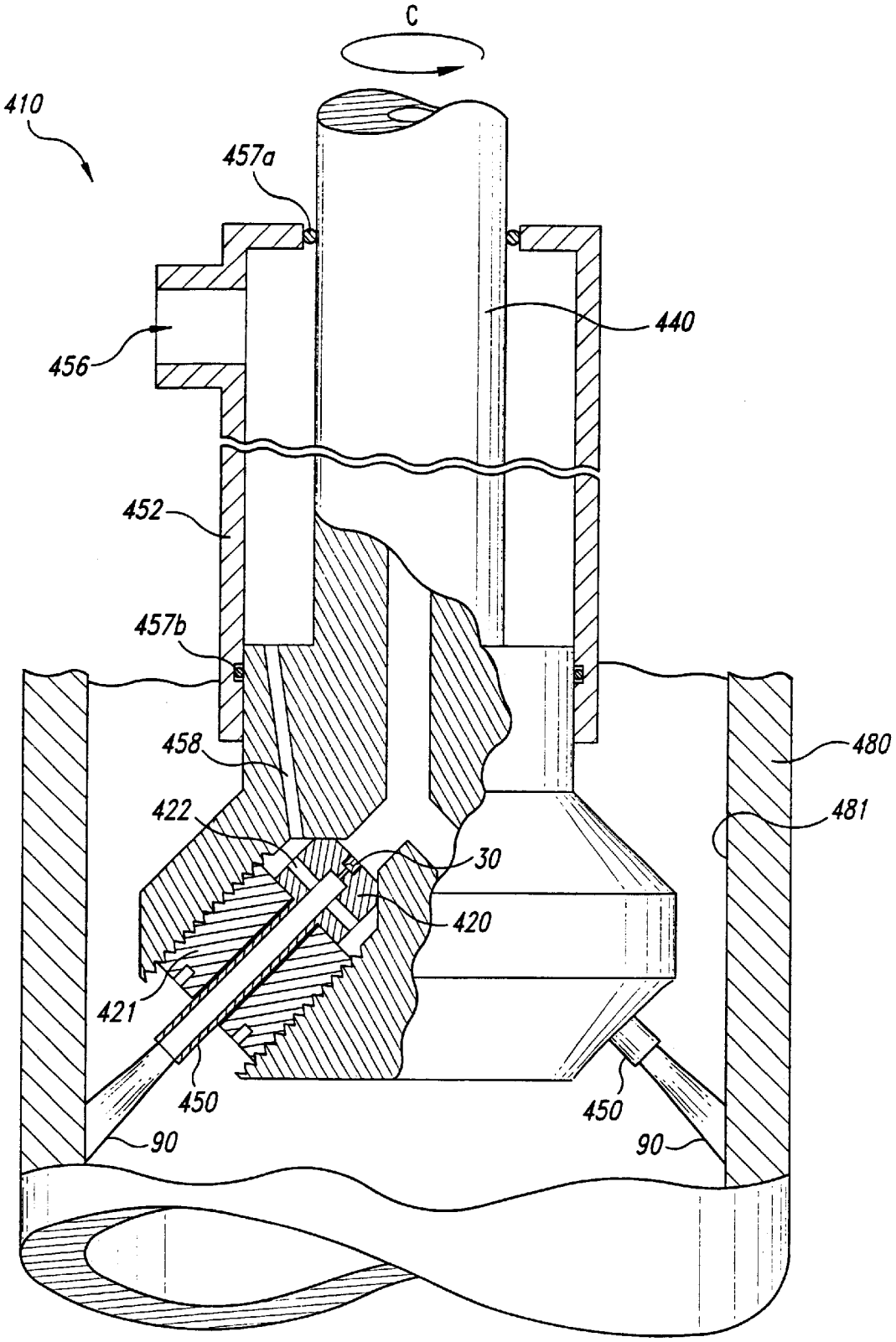
FIG. 5 is a partial cross-sectional side elevation view of an apparatus having a plurality of rotating nozzles for treating a cylindrical bore in accordance with still another embodiment of the invention.

FIG. 5 is a partial cross-sectional side elevation view of an apparatus 410 having rotatable delivery conduits 450 in accordance with another embodiment of the invention. In one aspect of this embodiment, the apparatus 410 can be used to treat the walls 481 of a cylinder 480, for example, the cylinder of an automotive engine block. The apparatus 410 can also be used to treat other axisymmetric (or non-axisymmetric) cavity surfaces, such as the interior surfaces of aircraft burner cans.

In one embodiment, the apparatus 410 can include a supply conduit 440 that is rotatably coupled to a primary fluid supply 41 (FIG. 1A) with a conventional rotating seal (not shown) so that the supply conduit 440 can rotate about its major axis, as indicated by arrow C. The supply conduit 440 can include two nozzle supports 420 (one of which is shown in FIG. 5), each having a nozzle 30 in fluid communication with the supply conduit 440. Each nozzle support 420 can be integrally formed with, or otherwise attached to, the corresponding delivery conduit 450 and can be secured in place relative to the supply conduit 440 with a retainer 421. In a preferred aspect of this embodiment, each delivery conduit 450 can be canted outward away from the axis of rotation of the supply conduit 440 so as to direct the fluid jets 90 toward the cylinder wall 481.

In the embodiment shown in FIG. 5, the delivery conduits 450 are inclined at an angle of approximately 45° relative to the cylinder walls 481. In other embodiments, the angle between the delivery conduits 450 and the cylinder walls 481 can have any value from nearly tangential to 90°. Although two delivery conduits 450 are shown in FIG. 5 for purposes of illustration, in other embodiments, the apparatus 410 can include more or fewer delivery conduits, positioned at the same axial location (as shown in FIG. 5) or at different axial locations.

The apparatus 410 can also include a manifold 452 disposed about the supply conduit 440. The manifold includes seals 457 (shown as an upper seal 457*a* and a lower seal 457*b*) that provide a fluid-tight fit between the stationary manifold 452 and the rotating supply conduit 440. Secondary fluid can enter the manifold 452 through the manifold entrance 456 and pass through manifold passages 458 and through the secondary flow apertures 422 to become entrained with the primary flow passing through the nozzle 30. The primary and secondary flows together from the fluid jets 90, as discussed above with reference to FIGS. 1A–B.

An advantage of an embodiment of the apparatus 410 shown in FIG. 5 is that it may be particularly suitable for treating the surfaces of axisymmetric geometries, such as engine cylinder bores. Furthermore, the same apparatus 410 can be used to treat the walls of cylinders having a wide variety of diameters because (as discussed above with reference to FIGS. 1A–B) the characteristics of the fluid jets 90 remain generally constant for a substantial distance beyond the delivery conduits 450. In addition, users can interrupt the flow of the primary fluid (which may be a liquid) after the surface treatment is completed and direct the secondary fluid alone (which may include air or another gas) toward the cylinder walls 481 to dry the cylinder walls prior to the application of other materials, such as high strength coatings. In yet a further embodiment, the high strength coatings themselves can be delivered to the cylinder walls 481 via the apparatus 410. Accordingly, the same apparatus 410 can be used to provide a wide variety of functions associated with treatment of cylinder bores or other substrate surfaces.

Figure 6:
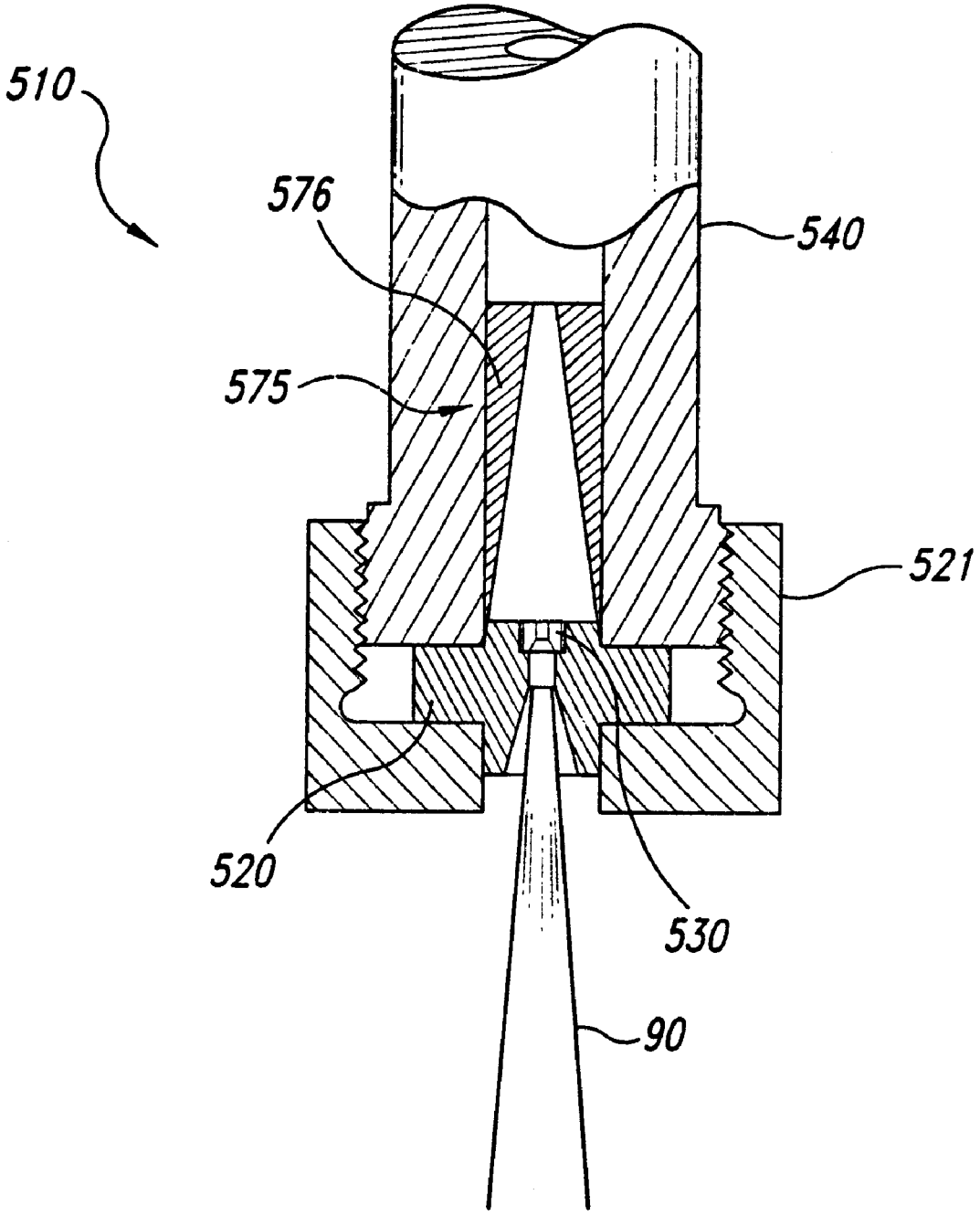
FIG. 6 is a partial cross-sectional side elevation view of an apparatus having a diverging conical conduit in accordance with yet another embodiment of the invention.

FIG. 6 is a partial cross-sectional side elevation view of an apparatus 510 having a turbulence generator 575 positioned upstream of a nozzle 530 in accordance with another embodiment of the invention. The nozzle 530 is supported by a nozzle support 520 which is in turn coupled to a supply conduit 540 with a retainer 521, in a manner generally similar to that discussed above with reference to FIGS. 1A–B. As discussed in greater detail below, the turbulence generator 575 can be used in lieu of, or in addition to, the secondary fluid discussed above to control the coherence of the fluid jet 90 exiting the nozzle 530.

In the embodiment shown in FIG. 6, the turbulence generator 575 includes a conical conduit 576 positioned upstream of the nozzle 530. The conical conduit 576 is oriented so that the flow area through the conduit increases in the downstream direction. Accordingly, flow passing through the conical conduit 576 will tend to separate from the internal walls of the conical conduit 576, forming wakes, eddies, and other turbulent flow structures. Upon exiting the nozzle 530, the turbulent flow, in the form of the fluid jet 90, can have an increased tendency for forming discrete droplets, as compared with a coherent jet flow (such as might be produced by a conical conduit that converges in the downstream direction). The reduced-coherence fluid jet 90 formed by the apparatus 510 may then be used for treating certain materials, such as fibrous materials and/or brittle materials, as was discussed above with reference to FIGS. 1A–B.

In one embodiment, the upstream opening of the conduit can have a diameter of between 0.005 inch and 0.013 inch and the conical conduit 576 can have a length of approximately 0.75 inch. In other embodiments, the conical conduit 576 can have other lengths relative to the upstream opening and/or can be replaced with a conduit having any shape, so long as the flow area increases in the downstream direction to produce a selected level of coherence. In still further embodiments, discussed below with reference to FIGS. 7–9, other means can be used to disturb the flow upstream of the nozzle 530 and reduce the coherence of the resulting fluid jet 90.

Figure 7:
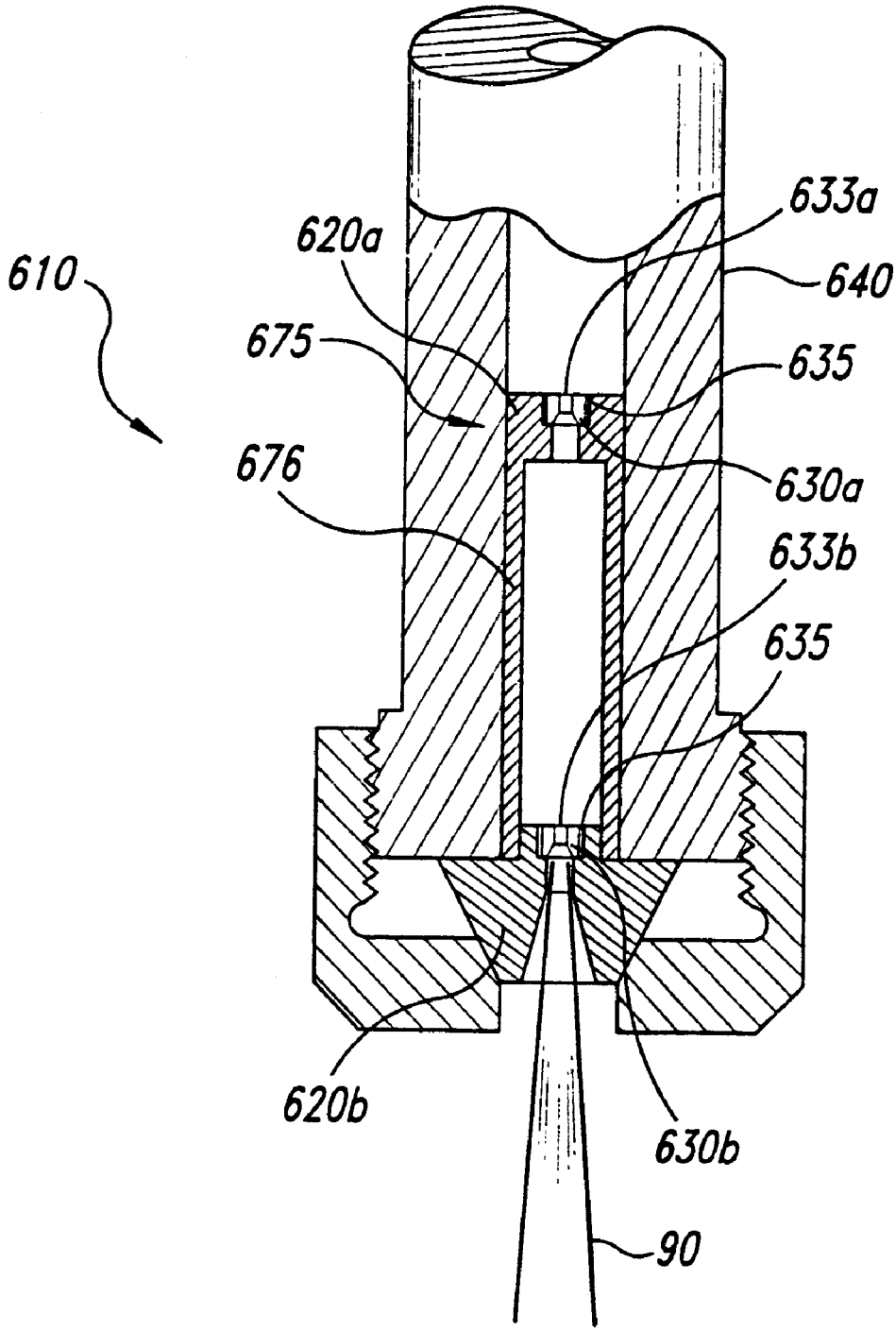
FIG. 7 is a partial cross-sectional side elevation view of an apparatus having an upstream nozzle and a downstream nozzle positioned axially downstream from the upstream nozzle in accordance with still another embodiment of the invention.
Figure 8A:
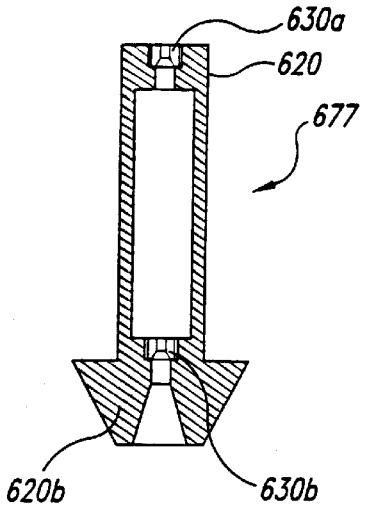
FIG. 8A is a cross-sectional side elevation view of a nozzle cartridge in accordance with yet another embodiment of the invention.
Figure 8B:
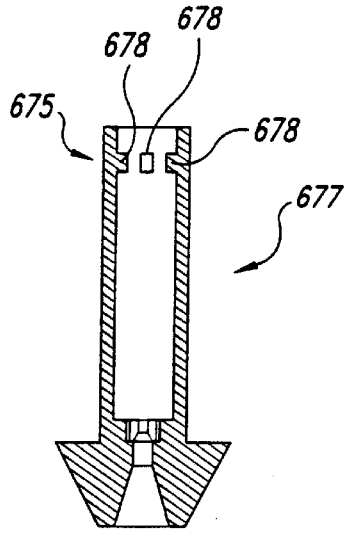
FIG. 8B is a cross-sectional side elevation view of a nozzle cartridge in accordance with a first alternate embodiment of the nozzle cartridge shown in FIG. 8A.
Figure 8C:
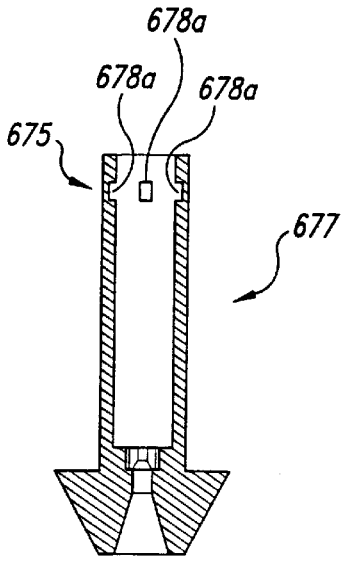
FIG. 8C is a cross-sectional side elevation view of a nozzle cartridge in accordance with a second alternate embodiment of the nozzle cartridge shown in FIG. 8A.
Figure 8D:
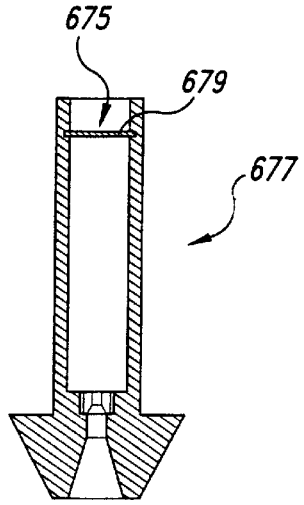
FIG. 8D is a cross-sectional side elevation view of a nozzle cartridge in accordance with a third alternate embodiment of the nozzle cartridge shown in FIG. 8A.

FIG. 7 is a partial cross-sectional elevation view of an apparatus 610 having a turbulence generator 675 that includes an upstream nozzle 630*a* having an upstream nozzle orifice 633*a*. The apparatus 610 further includes a downstream nozzle 630*b* having a downstream nozzle orifice 633*b* connected by a connecting conduit 676 to the upstream nozzle 630*a*. Each nozzle is sealed in place with a seal 635. As shown in FIG. 7, the connecting conduit 676 can include an upstream nozzle support portion 620*a* for supporting the upstream nozzle 630*a*. A separate downstream nozzle support portion 620*b* can support the downstream nozzle 630*b*. In alternate embodiments, discussed in greater detail below with reference to FIG. 8A, the downstream nozzle support 620*b* can be integrated with the connecting conduit 676.

In one embodiment, the orifices 633 through the upstream nozzle 630*a* and the downstream nozzle 630*b* have a generally circular cross-sectional shape. In other embodiments, either or both of the nozzle orifices 633 can have shapes other than round. For example, in one embodiment, the downstream nozzle 630*b* can have an orifice 633*b* with a flow area defined by the intersection of a cone and a wedge-shaped notch.

In a preferred embodiment, the upstream nozzle orifice 633*a* has a minimum flow area that is at least as great as the minimum flow area of the downstream nozzle orifice 633*b*. In a further preferred aspect of this embodiment, wherein both the upstream and downstream nozzle orifices 633 are round, the upstream nozzle orifice 633*a* has a minimum diameter at least twice as great as the minimum diameter of the downstream nozzle orifice 633*b*. Accordingly, the pressure loss of the flow passing through the nozzles 630 is less than about 6%. As the minimum flow area through the upstream nozzle 630*a* increases relative to the minimum flow area through the downstream nozzle 630*b*, the pressure loss through the upstream nozzle 630*a* decreases. At the same time, the flow disturbances created by the upstream nozzle 630*a* are reduced. Accordingly, in a preferred embodiment, the upstream nozzle 630*a* and the downstream nozzle 630*b* are selected to produce a level of turbulence that is sufficient to reduce the coherence of the fluid jet 90 to a level suitable for the selected application (such as cutting fibrous, brittle or other materials) without resulting in an undesirably large (and therefore inefficient) pressure loss.

In a further preferred aspect of the embodiment shown in FIG. 7, the distance between the upstream nozzle 630*a* and the downstream nozzle 630*b* is selected so that turbulent structures resulting from the fluid flow through the upstream nozzle 630*a* have not entirely disappeared by the time the flow reaches the downstream nozzle 630*b*. Accordingly, the distance between the two nozzles 630 may be a function of several variables, including the pressure of the fluid passing through the nozzles, the size of the nozzle orifices 633, and the desired level of coherence in the resulting fluid jet 90.

In the embodiment shown in FIG. 7, the upstream nozzle support portion 620*a* is integrated with the connecting conduit 676, and the downstream nozzle support 620*b* is a separate component. Accordingly, the upstream nozzle support portion 620*a* and the connecting conduit 676 can be removed as a unit from the supply conduit 640, and the downstream nozzle support 620*b* can be separately removed from the supply conduit 640. In an alternate embodiment, shown in FIG. 8A, the downstream nozzle support 620*b* can be integrated with the connecting conduit 676, which is in turn integrated with the upstream nozzle support portion 620*a* to form a removable cartridge 677. In a further aspect of this embodiment, the upstream nozzle 630*a* and downstream nozzle 630*b* can also be integrated with the cartridge 677. An advantage of this arrangement is that users can easily remove and/or replace the cartridge 677 as a unit. Furthermore, users can select a cartridge 677 that produces a fluid jet 90 (FIG. 7) having characteristics appropriate for a selected application.

In other embodiments, means other than those shown in FIGS. 6–8A can be used to increase the turbulence of the flow entering the downstream nozzle 630*b* and accordingly decrease the coherence of the fluid jet 90 exiting the downstream nozzle. For example, in one alternate embodiment, shown in FIG. 8B, the turbulence generator 675 can include one or more protrusions 678 that project from an interior surface of the cartridge 677 to create eddies and other turbulent structures in the adjacent fluid flow. In another embodiment shown in FIG. 8C, the protrusions 678 can be replaced with recesses 678*a* that similarly create eddies and other turbulent structures. In still another embodiment, shown in FIG. 8D, the turbulence generator 675 can include a wire 679 that extends across the path of the flow passing through the cartridge 677. In any of the foregoing embodiments discussed with respect to FIGS. 8B–8D, the turbulence generator 675 can be sized and configured to produce the desired level of turbulence in the adjacent flow, resulting in an exiting fluid jet 90 having the desired level of coherence.

Figure 9:
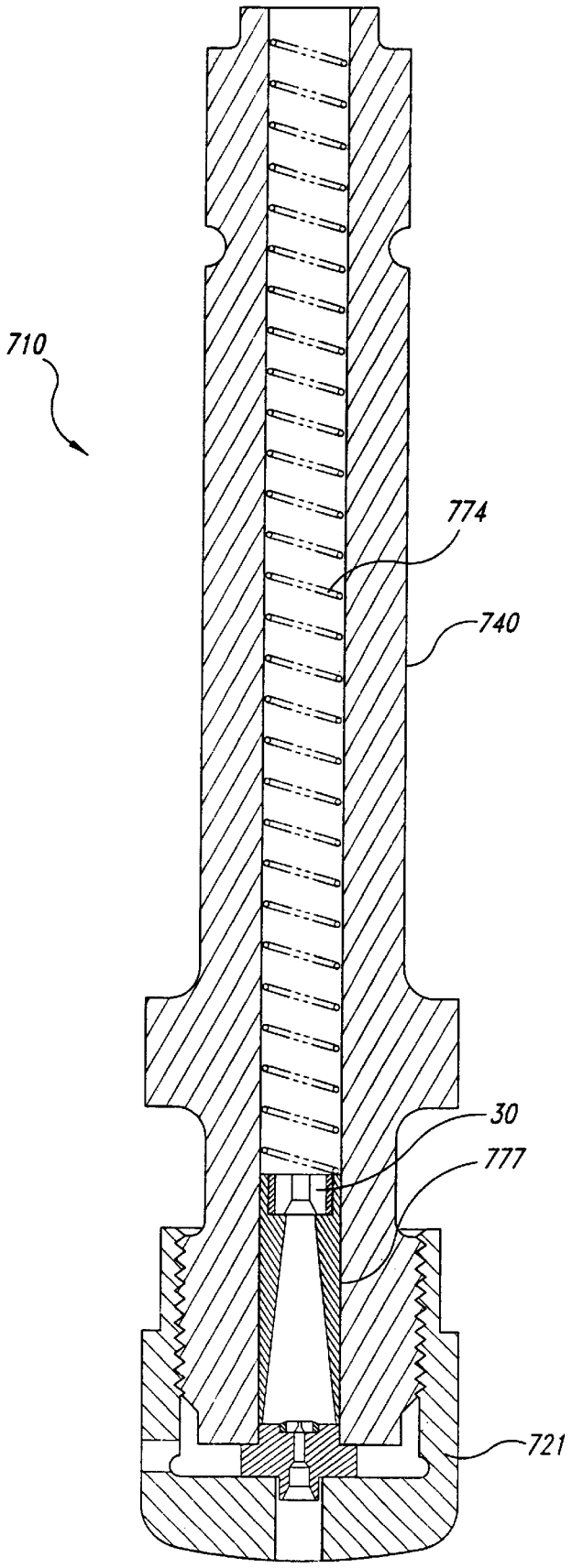
FIG. 9 is a cross-sectional side elevation view of an apparatus having a conical conduit biased against a nozzle support in accordance with yet another embodiment of the invention.

FIG. 9 is a cross-sectional side elevation view of an apparatus 710 having a spring 774 that biases a cartridge 777 toward a retaining nut 721, in accordance with yet another embodiment of the invention. Accordingly, a supply conduit 740, with the cartridge 777 installed, can be positioned at any orientation without the cartridge 777 sliding within the confines of the supply conduit 740. A further advantage of this embodiment is that cartridges 777 having a variety of axial lengths can be positioned within the supply conduit 740 without requiring modification to the supply conduit 740.

Figure 10:
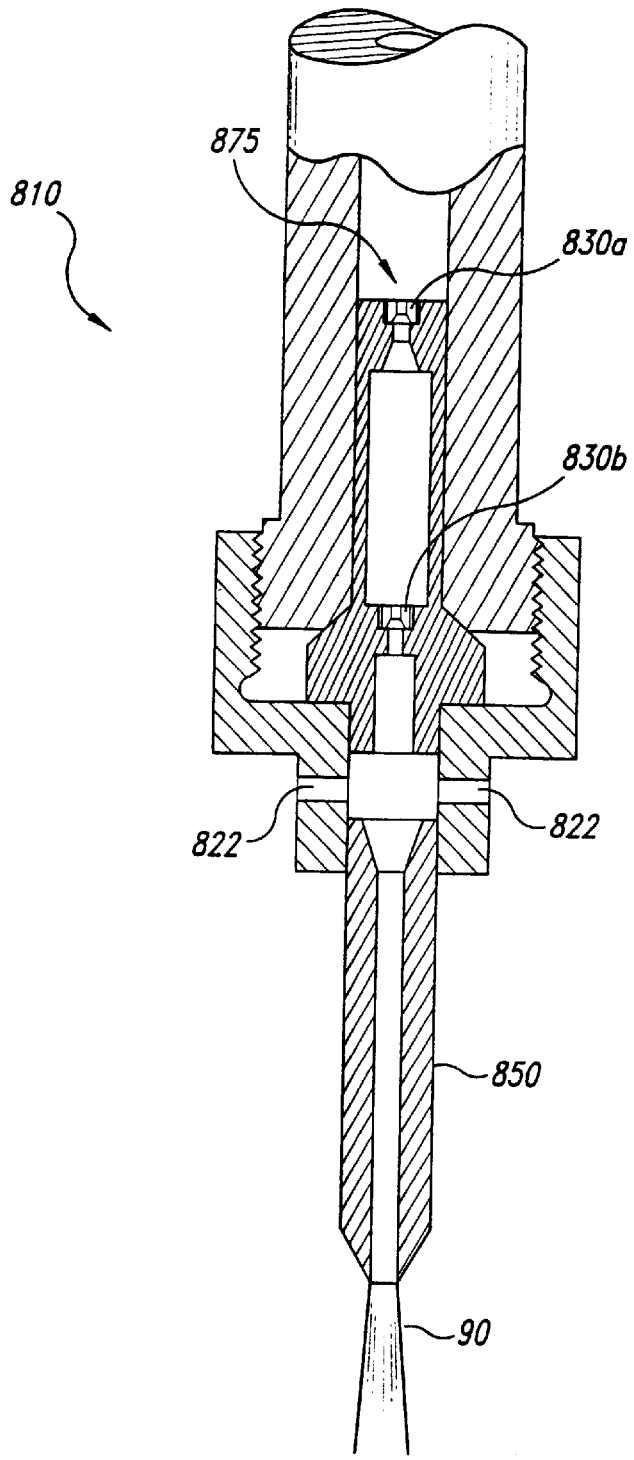
FIG. 10 is a partial cross-sectional side elevation view of an apparatus having upstream and downstream nozzles and downstream apertures for entraining a secondary flow in accordance with still another embodiment of the invention.

FIG. 10 is a partial cross-sectional side elevation view of an apparatus 810 having both a turbulence generator 875 positioned upstream of a downstream nozzle 830*b*, and secondary flow apertures 822 positioned downstream of the downstream nozzle 830*b*. The turbulence generator 875 can include an upstream nozzle 830*a*, as shown in FIG. 10, and in alternate embodiments, the turbulence generator 875 can include any of the devices shown in FIGS. 8B–8D, or other devices that generate a desired level of turbulence in the flow entering the downstream nozzle 830*b*. The secondary flow apertures 822 entrain secondary flow from a source of secondary fluid 41 (FIG. 1A) so that the combined secondary and primary flows pass through a delivery conduit 850, generally as was described above with reference to FIGS. 1A–B.

An advantage of the apparatus shown in FIG. 10 is that the upstream turbulence generator 875, in combination with the downstream secondary flow apertures 822, can provide users with greater control over the turbulence of the fluid flow passing therethrough, and therefore the coherence of the resulting fluid jet 90. For example, it may be easier for users to achieve the desired level of coherence of the fluid jet 90 by manipulating the flow both upstream and downstream of the downstream nozzle 830*b*.

From the foregoing it will be appreciated that, although specific embodiments of the invention have been described herein for purposes of illustration, various modifications may be made without deviating from the spirit and scope of the invention. For example, any of the turbulence generators shown in FIGS. 6–10 can be used in conjunction with a rotating device 410, such as is shown in FIG. 5. Thus, the present invention is not limited to the embodiments described herein, but rather is defined by the claims which follow.

What is claimed is:

1. An apparatus for generating a high pressure fluid jet for treatment of a selected surface, comprising:

a nozzle configured to be coupled to a source of a first fluid, the nozzle having a nozzle orifice extending therethrough in fluid communication with the source of the first fluid; and a delivery conduit having a first conduit opening in fluid communication with the nozzle orifice, the delivery conduit further having a second conduit opening spaced apart from the first conduit opening for directing the fluid jet, the delivery conduit having a conduit channel extending between the first and second conduit openings, a length of the conduit channel between the first and second conduit openings being at least approximately ten times a mean diameter of the second conduit opening, at least one of the nozzle and the delivery conduit having at least one aperture upstream of the second conduit opening, the aperture being configured to be coupled to a source of a second fluid.

2. The apparatus of claim 1 wherein the aperture is a first aperture, at least one of the nozzle and the delivery conduit further having a second aperture spaced apart from the first aperture, the first and second apertures being positioned at different locations along an axis extending between the first conduit opening and the second conduit opening.

3. The apparatus of claim 2 wherein a flow area of the conduit channel proximate to the second conduit opening is larger than a flow area of the channel proximate to the first conduit opening.

4. The apparatus of claim 1 wherein the aperture is a first aperture, at least one of the nozzle and the delivery conduit having a second aperture at approximately the same axial location as the first aperture and spaced apart from the first aperture in a transverse direction.

5. The apparatus of claim 1 wherein a ratio of a length of the conduit to a diameter of the conduit is in the range of approximately 10 to approximately 200.

6. An apparatus for generating a high pressure fluid jet for treatment of a selected surface, comprising:

a source of a first fluid having a pressure of at least approximately 10,000 psi;

a source of a second fluid;

a supply conduit coupled to the source of the first fluid;

a nozzle support body coupled to the supply conduit and having a nozzle passage in fluid communication with the supply conduit;

a nozzle positioned in the nozzle passage, the nozzle having a nozzle orifice in fluid communication with the source of the first fluid; and a delivery conduit proximate to the nozzle support body and having a first conduit opening in fluid communication with the nozzle orifice, the delivery conduit further having a second conduit opening spaced apart from the first conduit opening for directing the fluid jet, the delivery conduit having a conduit channel extending between the first and second conduit openings, a length of the conduit channel between the first and second conduit openings being at least approximately ten times a mean diameter of the second conduit opening, at least one of the nozzle and the delivery conduit having at least one aperture coupled to the source of the second fluid, the aperture being between the nozzle orifice and the second opening of the conduit.

7. The apparatus of claim 6 wherein the aperture is a first aperture, at least one of the nozzle and the delivery conduit having a second aperture spaced apart from the first aperture, the first and second apertures being positioned at different locations along an axis extending from the nozzle orifice to the second conduit opening.

8. The apparatus of claim 6 wherein the first fluid includes a liquid.

9. The apparatus of claim 8 wherein the first fluid includes water.

10. The apparatus of claim 6 wherein the second fluid includes a gas.

11. The apparatus of claim 10 wherein the second fluid is selected from air, oxygen, nitrogen and carbon dioxide.

12. The apparatus of claim 6 wherein the second fluid includes a liquid.

13. An apparatus for generating a high pressure fluid jet for treatment of a selected surface, comprising:

a nozzle configured to be coupled to a source of fluid, the nozzle having a nozzle orifice with a first opening in fluid communication with the source of the fluid and a second opening downstream of the first opening; and a conduit having a first conduit opening in fluid communication with the second opening of the nozzle orifice, the conduit further having a second conduit opening spaced apart from the first conduit opening for directing the fluid jet, the conduit having a channel extending between the first conduit opening and the second conduit opening, the conduit and the nozzle defining a flow passage extending therebetween, the flow passage having at least one aperture between the second opening of the nozzle orifice and the second opening of the conduit, the aperture being coupled to a vacuum source for drawing a vacuum through the conduit and through the aperture.

14. An apparatus for controlling a coherence of a high pressure fluid jet used for treating a selected surface, the apparatus comprising:

a conduit having an opening for supplying a high pressure flow of fluid;

a nozzle body positioned proximate to the opening of the conduit, the nozzle body having an orifice extending therethrough; and a turbulence generator positioned at at least one of an upstream and a downstream location relative to the orifice, the turbulence generator being positioned within a selected distance of the orifice to generate turbulence in the high pressure flow of fluid passing adjacent the turbulence generator and control a coherence of the high pressure flow exiting the orifice.

15. The apparatus of claim 14 wherein the turbulence generator is positioned upstream of the orifice.

16. The apparatus of claim 14 wherein the turbulence generator is positioned downstream of the orifice.

17. The apparatus of claim 14 wherein the turbulence generator includes a protrusion extending from a wall of the conduit into the high pressure flow of fluid.

18. The apparatus of claim 14 wherein the turbulence generator includes a recess in a wall of the conduit.

19. The apparatus of claim 14 wherein the fluid is a first fluid and the turbulence generator includes an aperture adjacent the flow of first fluid, the aperture being coupled to a source of a second fluid, the aperture being in fluid communication with the flow of first fluid for entraining the second fluid with the first fluid.

20. The apparatus of claim 19 wherein the aperture is positioned to direct the second fluid at an angle of at least approximately 90° relative to a direction of travel of the first fluid.

21. The apparatus of claim 19 wherein the aperture is positioned to direct the second fluid at an angle of less than approximately 90° relative to a direction of travel of the first fluid.

22. The apparatus of claim 14 wherein the nozzle body is a first nozzle body and the orifice is a first orifice, farther wherein the turbulence generator includes a second nozzle body upstream of the first nozzle body, the second nozzle body having a second orifice therethrough generally axially aligned with the first orifice.

23. The apparatus of claim 14 wherein the turbulence generator includes a portion of the conduit upstream of the nozzle body, the portion of the conduit having a first flow area and a second flow area downstream of the first flow area and larger than the first flow area.

24. An apparatus for generating a high pressure fluid jet for treatment of a selected surface, comprising:

a nozzle having a nozzle orifice extending therethrough, the nozzle being configured to withstand pressures generated by a first fluid passing through the nozzle orifice from a source of the first fluid where the first fluid has a static pressure of at least approximately 100,000 psi; and a delivery conduit having a first conduit opening in fluid communication with the nozzle orifice, the delivery conduit further having a second conduit opening spaced apart from the first conduit opening for directing the fluid jet, the delivery conduit having a conduit channel extending between the first and second conduit openings, the delivery conduit being configured to withstand pressures generated by the first fluid passing through the conduit channel, at least one of the nozzle and the delivery conduit having at least one aperture upstream of the second conduit opening, the aperture being coupled to a source of a second fluid.

25. The apparatus of claim 24 wherein the aperture is a first, aperture, at least one of the nozzle and the delivery conduit further having a second aperture spaced apart from the first aperture, the first and second apertures being positioned at different locations along an axis extending between the first conduit opening and the second conduit opening.

26. The apparatus of claim 24 wherein the aperture is a first aperture, at least one of the nozzle and the delivery conduit having a second aperture at approximately the same axial location as the first aperture and spaced apart from the first aperture in a transverse direction.

27. The apparatus of claim 24 wherein a ratio of a length of the conduit to a diameter of the conduit is in the range of approximately 10 to approximately 200.

28. An apparatus for controlling a coherence of a high pressure fluid jet used for treating a selected surface, the apparatus comprising:

a conduit having an opening for supplying a high pressure flow of fluid;

a nozzle body positioned proximate to the opening of the conduit, the nozzle body having an orifice extending therethrough; and turbulence generation means positioned at at least one of an upstream and a downstream location relative to the orifice, the turbulence generation means being positioned within a selected distance of the orifice to generate turbulence in the high pressure flow of fluid passing adjacent the turbulence generation means and control a coherence of the high pressure flow exiting the orifice.

29. The apparatus of claim 28 wherein the turbulence generation means is positioned upstream of the orifice.

30. The apparatus of claim 28 wherein the turbulence generation means is positioned downstream of the orifice.

31. The apparatus of claim 28 wherein the turbulence generation means includes a protrusion extending from a wall of the conduit into the high pressure flow of fluid.

32. The apparatus of claim 28 wherein the turbulence generation means includes a recess in a wall of the conduit.

33. The apparatus of claim 28 wherein the fluid is a first fluid and the turbulence generation means includes an aperture adjacent the flow of first fluid, the aperture being coupled to a source of a second fluid, the aperture being in fluid communication with the flow of first fluid for entraining the second fluid with the first fluid.

34. The apparatus of claim 33 wherein the aperture is positioned to direct the second fluid at an angle of at least approximately 90° relative to a direction of travel of the first fluid.

35. The apparatus of claim 33 wherein the aperture is positioned to direct the second fluid at an angle of less than approximately 90° relative to a direction of travel of the first fluid.

36. The apparatus of claim 28 wherein the nozzle body is a first nozzle body and the orifice is a first orifice, further wherein the turbulence generation means includes a second nozzle body upstream of the first nozzle body, the second nozzle body having a second orifice therethrough generally axially aligned with the first orifice.

37. The apparatus of claim 28 wherein the turbulence generation means includes a portion of the conduit upstream of the nozzle body, the portion of the conduit having a first flow area and a second flow area downstream of the first flow area and larger than the first flow area.

* * * * *